US006047822A

United States Patent [19]

Batten

[11] Patent Number: 6,047,822

[45] Date of Patent: Apr. 11, 2000

[54] PARTITIONED GOLF BAG AND METHOD OF FABRICATING SAME

[75] Inventor: Michael A. Batten, Paragould, Ark.

[73] Assignee: The Arnold Palmer Golf Company, Ooltewah, Tenn.

[21] Appl. No.: 09/007,956

[22] Filed: Jan. 16, 1998

[51] Int. Cl.[7] ..... A61J 55/00

[52] U.S. Cl. ..... 206/315.6; 206/315.3

[58] Field of Search ..... 206/315.3, 315.6; 248/96

[56] References Cited

U.S. PATENT DOCUMENTS

| | | | |
|---|---|---|---|
| 1,809,536 | 6/1931 | Tucker | 206/315.6 X |
| 2,546,416 | 3/1951 | Alter et al. | 206/315.6 |
| 2,602,676 | 7/1952 | Fieldhouse | 248/96 X |
| 3,554,255 | 1/1971 | Mangan | 206/315.6 |
| 3,667,078 | 6/1972 | Distasio | 16/104.92 |
| 3,674,072 | 7/1972 | Shuto | 206/315.6 |
| 3,729,036 | 4/1973 | McFadden . | |
| 3,842,876 | 10/1974 | Cristelli | 206/315.6 X |
| 4,172,484 | 10/1979 | Henning | 206/315.6 |
| 4,181,167 | 1/1980 | Ret | 206/315.6 |
| 5,029,703 | 7/1991 | Dulyea, Sr. | 206/315.3 |
| 5,094,345 | 3/1992 | Yonnetti | 206/315.2 |
| 5,125,507 | 6/1992 | Graziano, Jr. | 206/315.6 |
| 5,255,781 | 10/1993 | Dulyea, Sr. | 206/315.6 |
| 5,311,987 | 5/1994 | Shin | 206/315.6 |
| 5,450,955 | 9/1995 | Olson | 206/315.6 |
| 5,458,240 | 10/1995 | Rich et al. | 206/315.3 |
| 5,573,112 | 11/1996 | Kim | 206/315.6 |
| 5,662,058 | 9/1997 | Wang | 112/475.08 |
| 5,785,173 | 7/1998 | Kim | 206/315.3 X |

FOREIGN PATENT DOCUMENTS

| | | | |
|---|---|---|---|
| 8333 | 2/1911 | United Kingdom | 206/315.5 |

*Primary Examiner*—Sue A. Weaver
*Attorney, Agent, or Firm*—Miller & Martin LLP

[57] ABSTRACT

The present invention relates to a golf bag and golf bag divider insert having ten full length partitions within the club compartment of the bag that effectively separates the clubs within the bag's club compartment. A method for fabricating a partitioned golf bag or golf bag divider insert to provide ten full length compartments within the club compartment of the bag that effectively separates the clubs within the bag's club compartment is also presented. The golf bag divider comprises a tubular outer wall, a central divider assembly bisecting the tube formed by the outer wall and four side divider assemblies stitched to the central divider assembly further partitioning the tube into ten full length compartments.

19 Claims, 3 Drawing Sheets

PARTITIONED GOLF BAG AND METHOD OF FABRICATING SAME

BACKGROUND OF THE INVENTION

The present invention relates generally to golf bags and golf bag dividers and particularly to a partitioned golf bag and golf bag divider having ten full length club compartments and a method of fabricating such a partitioned golf bag and divider.

The desirability of maintaining golf clubs separately within a golf bag is a well recognized method of extending the useful life of golf clubs as it prevents the heads, shafts and grips of the clubs from knocking or rubbing together while within the bag. Unless prevented, such knocking or rubbing will, over the course of time, deteriorate the condition of the clubs. Intermingling the shafts of clubs within the golf bag is especially apt to damage graphite or other composite shafts which are the favorite of many golfers.

A set of golf clubs is a relatively expensive item of sporting equipment that is typically carried in a relatively lightweight golf bag having a central compartment for clubs. During a typical round of golf, however, a player's golf bag is subject to almost continual jarring and bouncing regardless of whether it is carried by the golfer himself or on a hand-pulled or motorized golf cart. In addition, when the golf clubs are transported by car or plane, they are subject to additional vibration and jarring. In a golf bag with a single club compartment, the clubs will obviously be subjected to a great deal of punishment and wear as the club heads, shafts and grips constantly shift and rub against each other.

The need for a means of separating the clubs within the club compartment is well recognized and it is commonplace for even the most lightweight of golf bags to have one or more rod-like partition elements located chordally across the club compartment proximate to the open end of the bag. These partition elements generally serve to separate the open end of the club compartment into a plurality of compartments. Even with these partition elements, the clubs are still subject to intermingling within the interior of the club compartment and continue to suffer the damaging effects concomitant with such intermingling.

Many other devices for separating clubs within a golf bag are known in the prior art. Many of these devices are built as an integral part of a golf bag while others may be an insert to be installed into the club compartment of a golf bag. Some of these devices effectively separate clubs within the club compartment, but substantially increase the overall weight of the bag or are difficult to fabricate.

SUMMARY OF THE INVENTION

The present invention, which will be described subsequently in greater detail, comprises a golf bag or golf bag divider insert having ten individual, full length compartments which together divide the entire cross-sectional area of the golf bag so that a set of golf clubs may be carried adequately separated within the bag. A unique method of fabricating a partitioned golf bag or divider insert having ten individual, full length compartments is also presented.

It is, therefore, an object of the present invention to provide a golf bag or golf bag divider insert having ten full length club compartments within the bag that adequately separate the clubs within the bag thereby reducing wear and tear on the clubs while they are stored or transported within the golf bag.

It is a further object of the present invention to provide a partitioned golf bag or golf bag divider insert that is lightweight.

It is another object of the present invention to provide a partitioned golf bag or golf bag divider insert which is inexpensive and easily manufactured.

It is another object of the present invention to provide a method of manufacturing a partitioned golf bag or golf bag divider insert having ten full length compartments within the bag that effectively separate the clubs within the bag.

These and other objects, advantages and applications of the present invention will become apparent to those skilled in the art when the accompanying description of the preferred embodiment of the present invention is read in conjunction with the accompanying drawings.

DETAILED DESCRIPTION OF THE DRAWINGS

Figure 1:
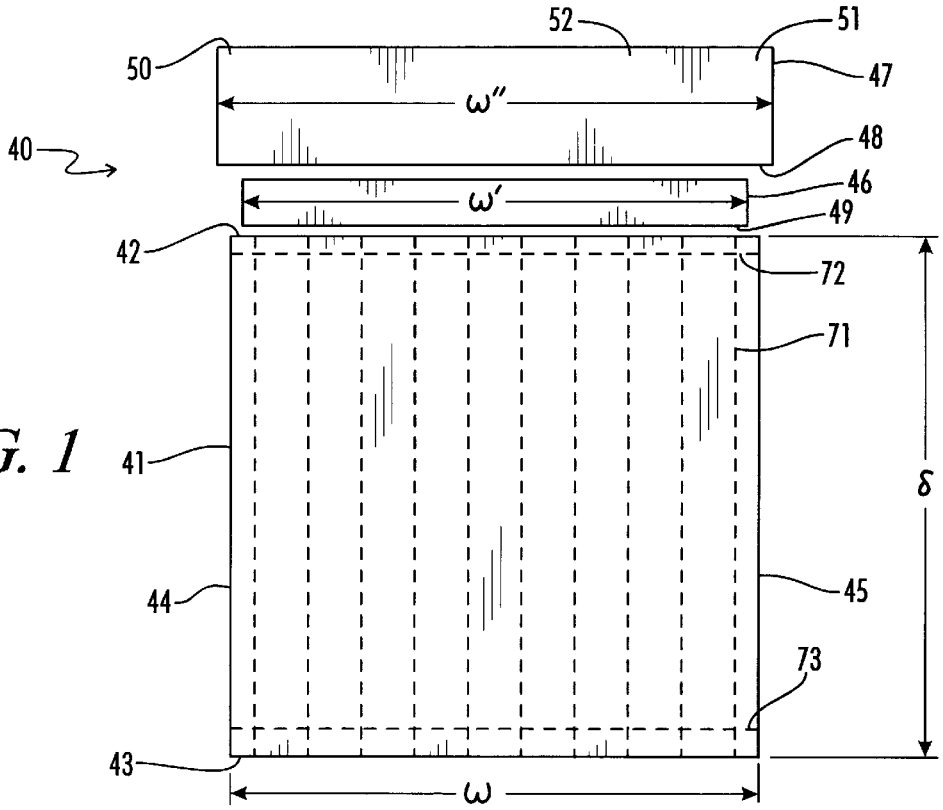
FIG. 1 is an exploded plan view of the outer shell assembly of the golf bag of the present invention.

Referring now to the drawings and in particular to FIG. 1, an exploded view of the divider shell assembly 40 of the golf bag or golf bag divider insert of the present invention is shown. Alternate embodiments of the present invention may be used as a complete golf bag or as a divider insert which can be inserted into an existing golf bag to partition the golf bag into a plurality of full length club compartments. The embodiment described herein is will be described primarily in terms of a golf bag for the sake of completeness. However, the certain portions of the present invention may alternately be made useful as a golf bag divider insert. Description of both preferred embodiments is intended.

Divider shell assembly 40 comprises divider wall 41 made of a heavy, tightly woven fabric, such as nylon, which may be suitably trimmed to provide a pleasing appearance as well as a strong, durable outer skin. Initially, divider wall 41 is generally rectangular in shape and has opposing top and bottom edges 42 and 43 and opposing left and right side edges 44 and 45. As explained in more detail below, in the finally assembled golf bag, left side edge 44 is stitched to right side edge 45 forming a rounded tube in which divider wall 41 comprises the body or outside wall of the golf bag (or golf bag divider insert) surrounding a tubular space. Thus, the divider wall 41 has a length $\delta$ which typically ranges between 30 to 33 inches and a width $\omega$ substantially equal to the desired inside circumference of the golf bag.

Divider brace 46 having a length $\omega'$ slightly shorter than the width $\omega$ of divider wall 41 (preferably between ½ to 1¾ inches shorter) is stitched proximate to the top edge 42 of divider wall 41. In the preferred embodiment, divider brace 46, as well as the other partition braces discussed below, are preferably made from a lightweight plastic polymer of a thickness sufficient to provide moderate flexibility without being overly rigid or heavy or inhibiting the stitching-together of various parts. A 0.45 gauge polypropylene plastic is the currently preferred plastic polymer.

Padded upper fabric 47 having a length ω" slightly longer than the width ω of divider wall 41 (preferably between ¼ to 1¼ inches longer) is then sewn to divider brace 46 and divider wall 41 atop divider brace 46 such that the lower edge 48 of padded fabric 47 is substantially flush with the lower edge 49 of divider brace 46 and the end portions 50 and 51 of padded fabric 47 extend past each respective side edge 44 and 45 of divider wall 41. In the golf bag divider insert embodiment of the present invention, the upper portion 52 of padded fabric 47 is folded over the divider brace 46 and stitched to the opposing face of the divider wall 41.

It is recommended that the divider wall 41 be marked prior to assembly with a plurality of longitudinal chalk lines 71 indicating the desired points at which additional elements of the golf bag are to be sewn. A top 72 latitudinal chalk line may also be used to mark the points of attachment for divider brace 46 and padded fabric 47. Similarly, in the golf bag embodiment of the present invention, a bottom latitudinal chalk line 73 may be used to mark where the bottom plate (shown in FIG. 6) is stitched to the divider shell assembly 40.

Figure 2:
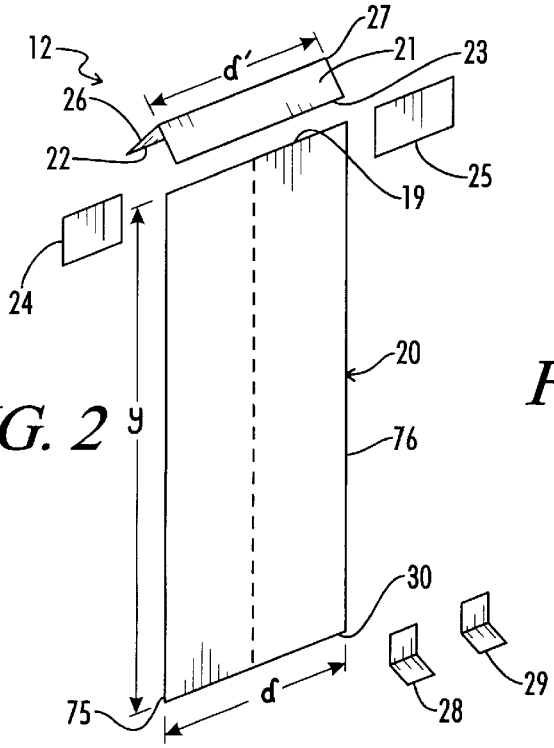
FIG. 2 is an exploded perspective view of a side divider assembly of the present invention.

FIG. 2 shows an exploded perspective view of a side divider assembly 12 of the present invention. The present invention utilizes four such side divider assemblies 12. Each side divider assembly 12 comprises a planar side partition wall 20 made of the same fabric as the divider wall 41. In one preferred embodiment, side partition wall 20 has a width d of 7⅛ inches, though the width d will vary depending upon changes in the desired circumference of the golf bag and the desired size and shape of the partitions. Side partition wall also has a length y substantially equal to the length δ of divider wall 41.

Figure 6:
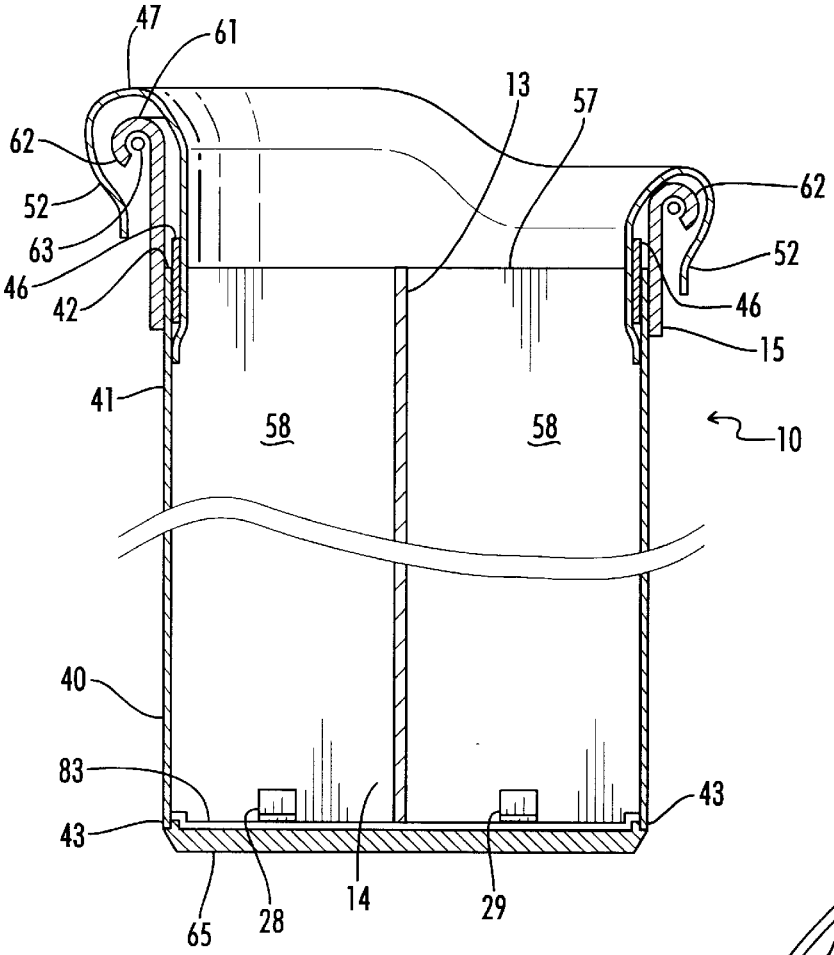
FIG. 6 is a cross-sectional view of the sewing step wherein the outer shell assembly is attached to the collar and bottom plate of the present invention.

Padded side fabric 21, having a length d' substantially equal to the width d of side partition wall 20, is folded lengthwise and stitched along its lengthwise edges 22, 23 to the top portion 19 of side partition wall 20, thus forming a sleeve into which side braces 24, 25 are inserted. Outer edges 26 and 27 of padded fabric 21 are then sewn to side partition wall 20 at the opposing side edges 75, 76 of the side partition wall 20, thus enclosing the braces 24, 25 within the padded fabric 21. Side braces 24, 25 are preferably made from plastic polymer similar to divider brace 46 and are of slightly different lengths, the actual lengths depending on the desired size of the golf bag and individual compartments. In the illustrations, brace 25 is longer than brace 24. In one preferred embodiment, retaining members, such as elastic tabs 28, 29, are sewn to the lower end 30 of side partition 20 and, in the final product, are also sewn to the bottom plate 65 of the golf bag 10 as shown in FIG. 6.

Figure 3:
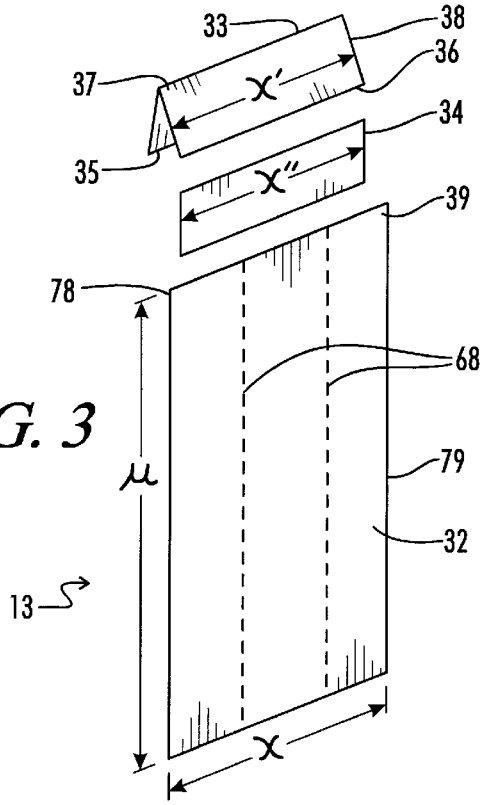
FIG. 3 is an exploded perspective view of the center divider assembly of the present invention.

Turning them to FIG. 3, an exploded perspective view of the center divider assembly 13 of the present invention is shown. Center divider assembly 13 comprises planar center partition wall 32 made of nylon having a width χ substantially equal to the diameter of the main club compartment of the golf bag to allow it to be stitched across the diameter, and having a length μ substantially equal to the length δ of the divider wall 41 of the golf bag. Padded center fabric 33, having a length χ' substantially the same as the width χ of the center partition wall 32, is folded in half lengthwise, and the lengthwise edges 35, 36 are sewn to the top portion 39 of both faces (front and rear) of the center partition wall 32, again forming an open-ended sleeve into which a plastic center brace 34 may be inserted. The outer edges 37, 38 of padded fabric 33 are then stitched to the center partition wall 32 at opposing side edges 78 and 79, thus enclosing center brace 34 within padded fabric 33. Center brace 34 also has a length χ" substantially the same as the width χ of center partition wall 32.

Each face of center partition wall 32 may be marked with longitudinal chalk-lines 68 to facilitate attachment of side divider assemblies. In the preferred embodiment of the present invention, pairs of lines 68 on the front and rear faces of the center divider assembly 13 divide the width χ of the center divider assembly 13 approximately into thirds.

Figure 4:
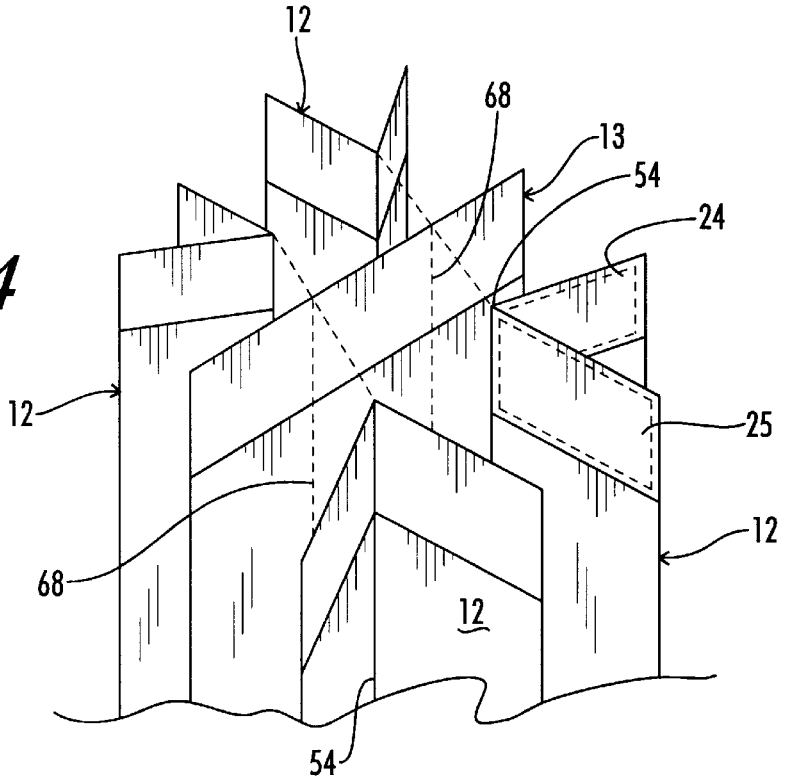
FIG. 4 is an exploded perspective view of the full divider assembly of the present invention.
Figure 5:
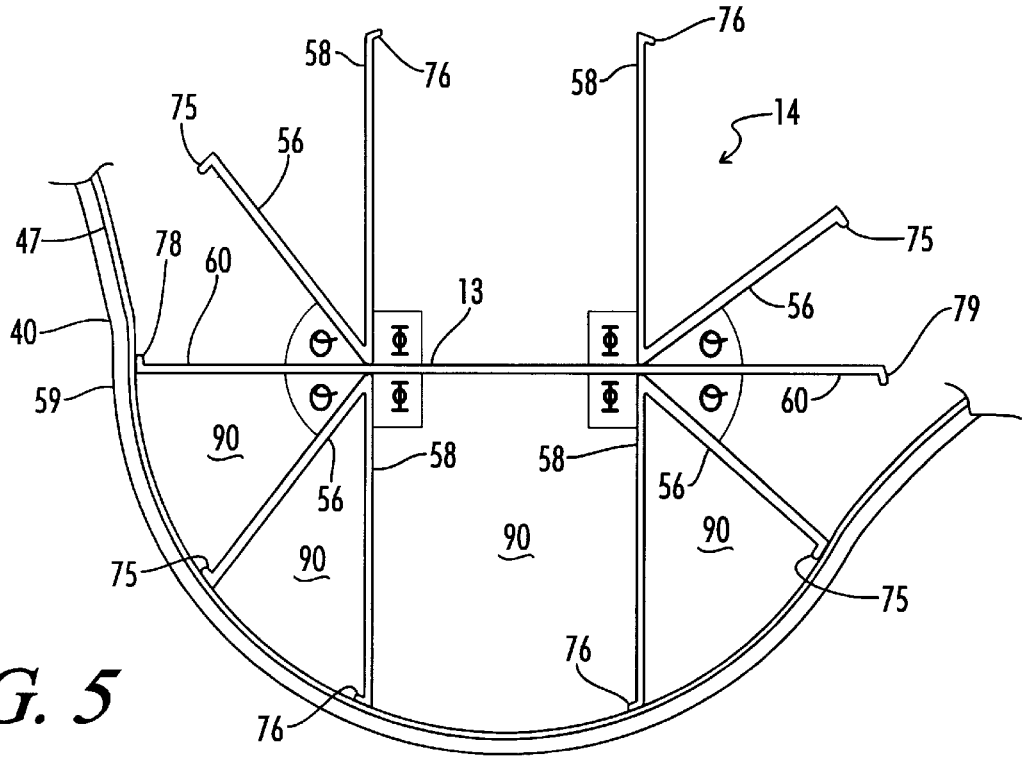
FIG. 5 is a top plan view of the sewing step wherein the full divider assembly is attached to the outer shell assembly.

Referring now to FIG. 4, each of the four side divider assemblies 12 are attached, one at a time, to a corresponding longitudinal line 68 on the center divider assembly 13. First, each side divider assembly 12 is folded at the point between side braces 24 and 25 thereby creating a longitudinal fold 54. Next, the folded side divider assembly 12 is stitched along the fold 54 to a corresponding line 68 on the center divider assembly 13. When stitching each side divider assembly 12 to the center divider assembly 13, care must be taken to ensure that the longer brace 25 is oriented towards the middle of the center divider assembly 13. This process is repeated for each of the side divider assemblies 12, thus yielding a full divider assembly 14 such as shown in FIG. 5. As shown in FIG. 5, the opposing side edges 78 and 79 of the center divider assembly 13 form partitions 60. Likewise, the opposing side edges 75 and 76 of the side divider assemblies form partitions 56 and 58. For ease of reference, the portion of each side divider assembly 12 containing the longer brace is designated partition 58 while the portion containing the shorter brace is designated partition 56.

In the next sewing step, shown in FIG. 5, full divider assembly 14 is sewn to divider shell assembly 40. Specifically, the ends 75, 76, 78 and 79 of each of the partitions 56, 58 and 60 of the full divider assembly 14 are sewn sequentially to the divider shell assembly 40. As shown in FIG. 6, the top edge 57 of each partition 56, 58 and 60 is stitched flush with the top edge 42 of the divider wall 41 of the divider shell assembly 40.

Returning then to FIG. 5, when each partition 56, 58 and 60 of the full divider assembly 14 is sewn to the divider shell assembly 40, the divider shell assembly 40 forms a rounded or tubular wall 59 and the partitions 56,58 and 60 of the full divider assembly 14 separate the interior of the tube thus formed into a plurality of compartments 90 which run the full length δ (shown in FIG. 1) of the divider shell assembly 40. Note that the ends 78, 79 of the partitions 60 formed by the center divider assembly 13 are sewn to either end of a diameter of the tubular wall, thus bisecting the main compartment or interior of the tube. Partition 58 (containing the longer brace 25 as shown in FIG. 4) of each side divider assembly 12 is sewn to the divider shell assembly 40 at an angle Φ of approximately 90° to the central divider assembly 13. Partition 56 (containing the shorter brace 24 as shown in FIG. 4) of each side divider assembly 12 is stitched to the divider shell assembly 40 at an angle θ which may range between 35° and 55° to the center divider assembly 13 towards the nearest portion of the divider shell assembly 40. The size of the golf bag or divider insert to be formed will determine the spacing of the stitches connecting the full divider assembly 14 to the divider shell assembly 40. Again, it is recommended that the divider wall 41 be marked with chalk lines 71 prior to assembly (as shown in FIG. 1) to indicate the desired points of attachment. Note also that the partitions 56, 58 and 60 are sewn to the same side of the divider shell assembly 40 to which padded fabric 47 was initially sewn, thus leaving the upper portion 52 of padded fabric 47 extending above the top 61 of the collar 15.

After the final partition is sewn to the divider shell assembly 40, the left and right side edges 44, 45 of the divider shell assembly 40 (shown in FIG. 1) are sewn together, including end portions 50, 51 of the padded fabric 47 of the divider shell assembly 40. After this step, a suitable golf bag divider insert having ten full length club compartments 90 has been formed. The insertion of such a golf bag divider insert into an existing golf bag results in a golf bag having such partitions. In one preferred embodiment, a rounded bottom support 83 of lightweight plastic (shown in FIG. 6) is sewn to the bottom edge 43 of the divider shell assembly 40 of the divider insert and then attached, such as with rivets, to the bottom of the golf bag into which the divider insert is to be placed.

FIG. 6 is a side cross-sectional view of the attachment of the divider shell assembly 40 to a collar 15 and a bottom plate 65, thus creating a golf bag 10. Collar 15 is a collar of any desired shape, typically round or ovular, and is formed from lightweight, molded plastic polymer having a circumference substantially the same as the circumference of the round top edge 42 of the divider shell assembly 40. The top 61 of the collar 15 may be of any desired shape, such as the illustrated two tier shape, and has a lip 62 around the circumference of the top 61 into which an appropriately sized structural member, such as steel ring 63, is attached to keep the collar from distortion.

The divider shell assembly 40 is placed into the collar 15 and the top edge 42 of the divider shell assembly 40 is sewn to the collar 15. In one preferred embodiment, the upper portion 52 of padded fabric 47 is then folded around lip 62 of collar 15 and sewn to the outer surface of the collar 15 around the entire circumference of the collar 15. In an alternate preferred embodiment, the padded fabric 47 is sewn proximate to the top 61 of the collar 15 and an additional piece of fabric or plastic webbing (not shown) is sewn around the lip 62 of the collar 15.

A bottom plate 65 is then attached, such as by sewing or, preferably, riveting, to the bottom edge 43 of divider shell assembly 40 across the other open end of the divider shell assembly 40. Retaining members such as elastic tabs 28, 29, are also sewn to bottom plate 65 to hold the partitions 56 in the desired configuration for appropriately sizing the individual club compartments. Bottom plate 65 is typically molded plastic, though preferably made sturdier than the other plastic portions of the golf bag and may optionally be fitted with one or more drain holes.

In one preferred embodiment, an additional support member in the form of a rounded bottom support 83 of lightweight plastic is sewn to the bottom edge 43 of the divider shell assembly 40. This retaining member is then attached, such as with rivets, to the bottom plate 65 to assist in maintaining the rounded shape of the divider shell assembly 40 and to provide a more secure means of attaching the divider shell assembly 40 to the bottom plate 65.

Figure 7:
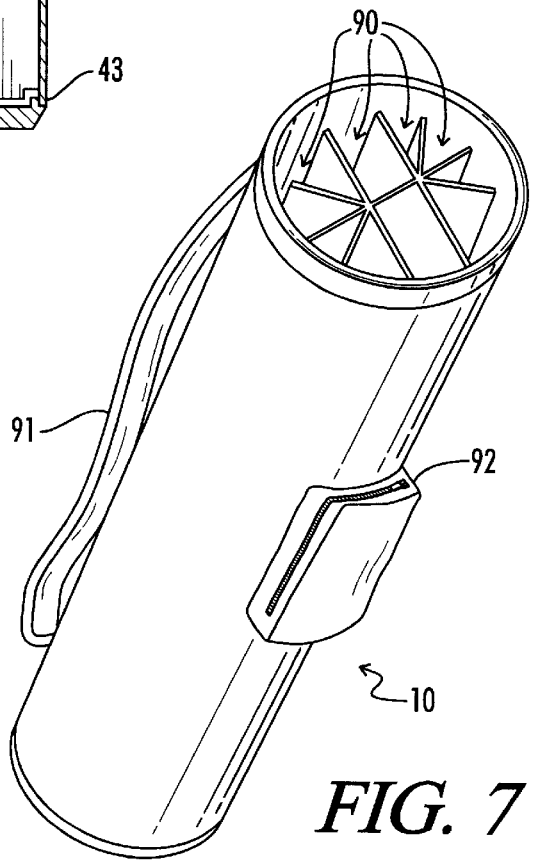
FIG. 7 is a perspective view of a typical golf bag having ten full length compartments made according to the present invention.

FIG. 7 is a perspective view of a typical golf bag 10 having the ten full length compartments 90 made according to the present invention. Features typically found on golf bags may be added as desired, such as strap 91 and ball compartment 92.

While several embodiments of the present invention have been disclosed, it is to be understood by those skilled in the art that other forms can be adopted,

What is claimed is:

1. A golf bag divider having ten full length club compartments comprising:

(a) a tubular outside wall forming an open-ended main club compartment within the outside wall; and (b) a full divider assembly within the main club compartment having a length substantially equal to the outside wall and a plurality of partitions stitched to the outside wall, said full divider assembly further comprising:

(i) a planar center divider assembly which bisects the main club compartment, said center divider assembly having first and second opposing ends, first and second opposing faces, and a width substantially equal to the diameter of the main club compartment, each opposing end of the center divider assembly being stitched to the outside wall;

(ii) a first planar side divider assembly having opposing ends and being folded lengthwise and stitched along the fold to the first opposing face of the center divider assembly along a line approximately one third of the width of the center divider assembly from the first opposing end of the center divider assembly, said opposing ends of the first side divider assembly being further stitched to the outside wall;

(iii) a second planar side divider assembly having opposing ends and being folded lengthwise and stitched along the fold to the first opposing face of the center divider assembly along a line approximately one third of the width of the center divider assembly from the second opposing end of the center divider assembly, said opposing ends of the second side divider assembly being further stitched to the outside wall;

(iv) a third planar side divider assembly having opposing ends and being folded lengthwise and stitched along the fold to the second opposing face of the center divider assembly along a line approximately one third of the width of the center divider assembly from the first opposing end of the center divider assembly, said opposing ends of the third side divider assembly being further stitched to the outside wall; and (v) a fourth planar side divider assembly having opposing ends and being folded lengthwise and stitched along the fold to the second opposing face of the center divider assembly along a line approximately one third of the width of the center divider assembly from the second opposing end of the center divider assembly, said opposing ends of the fourth side divider assembly being further stitched to the outside wall;

(c) wherein one end of each side divider assembly is stitched to the outside wall at an angle of approximately 90° to the center divider assembly and the opposed end of each side divider assembly is stitched to the outside wall at an angle ranging between 35° and 55° to the center divider assembly towards the nearest portion of the outside wall.

2. A golf bag divider according to claim 1 wherein a bottom plate is attached across one open end of the main club compartment.

3. A golf bag divider according to claim 2 wherein a collar is attached to the other open end of the main club compartment.

4. A golf bag divider according to claim 1 wherein at least one support member is attached across one open end of the main club compartment.

5. A golf bag divider according to claim 1 wherein the outside wall further comprises:

(a) a fabric divider wall having a top edge;

(b) a divider brace having a lower edge, said divider brace stitched proximate to the top edge; and (c) upper fabric having a lower edge and an upper portion, said lower edge of the upper fabric stitched to the divider wall substantially flush with the lower edge of the divider brace.

6. A golf bag divider according to claim 5 wherein a bottom plate is attached across one open end of the main club compartment.

7. A golf bag divider according to claim 6 wherein a collar is attached to the other open end of the main club compartment.

8. A golf bag divider according to claim 7 wherein the upper portion of the upper fabric is folded over the top of the collar and stitched to an outer surface of the collar.

9. A golf bag divider according to claim 1 wherein each side divider assembly further comprises:

(a) a fabric side partition wall having a top portion; and (b) side fabric forming a closed sleeve stitched to the top portion of the side partition wall, said sleeve containing a longer and a shorter brace.

10. A golf bag divider according to claim 1 wherein the center divider assembly further comprises:

(a) a fabric center partition wall having a top portion; and (b) center fabric forming a closed sleeve stitched to the top portion of the center partition wall, said sleeve containing a brace.

11. A golf bag divider having ten full length club compartments comprising:

(a) a tubular outside wall forming an open-ended main club compartment within the outside wall; and (b) a full divider assembly within the main club compartment having a length substantially equal to the outside wall and a plurality of partitions stitched to the outside wall, said full divider assembly further comprising:

(i) a planar center divider assembly which bisects the main club compartment, said center divider assembly having first and second opposing ends, first and second opposing faces, and a width substantially equal to the diameter of the main club compartment, each opposing end of the center divider assembly being stitched to the outside wall;

(ii) a first planar side divider assembly having opposing ends and being folded lengthwise and stitched along the fold to the first opposing face of the center divider assembly along a line approximately one third of the width of the center divider assembly from the first opposing end of the center divider assembly said opposing ends of the first side divider assembly being further stitched to the outside wall;

(iii) a second planar side divider assembly having opposing ends and being folded lengthwise and stitched along the fold to the first opposing face of the center divider assembly along a line approximately one third of the width of the center divider assembly from the second opposing end of the center divider assembly, said opposing ends of the second side divider assembly being further stitched to the outside wall;

(iv) a third planar side divider assembly having opposing ends and being folded lengthwise and stitched along the fold to the second opposing face of the center divider assembly along a line approximately one third of the width of the center divider assembly from the first opposing end of the center divider assembly said opposing ends of the third side divider assembly being further stitched to the outside wall; and (v) a fourth planar side divider assembly having opposing ends and being folded lengthwise and stitched along the fold to the second opposing face of the center divider assembly along a line approximately one third of the width of the center divider assembly from the second opposing end of the center divider assembly, said opposing ends of the fourth side divider assembly being further stitched to the outside wall;

(c) wherein each side divider assembly further comprises:

(i) a fabric side partition wall having a top portion; and (ii) side fabric forming a closed sleeve stitched to the top portion of the side partition wall, said sleeve containing a longer and a shorter brace.

12. A golf bag divider according to claim 11 wherein a bottom plate is attached across one open end of the main club compartment.

13. A golf bag divider according to claim 12 wherein a collar is attached to the other open end of the main club compartment.

14. A golf bag divider according to claim 11 wherein at least one support member is attached across one open end of the main club compartment.

15. A golf bag divider according to claim 11 wherein the outside wall further comprises:

(a) a fabric divider wall having a top edge;

(b) a divider brace having a lower edge, said divider brace stitched proximate to the top edge; and (c) upper fabric having a lower edge and an upper portion, said lower edge of the upper fabric stitched to the divider wall substantially flush with the lower edge of the divider brace.

16. A golf bag divider according to claim 15 wherein a bottom plate is attached across one open end of the main club compartment.

17. A golf bag divider according to claim 16 wherein a collar is attached to the other open end of the main club compartment.

18. A golf bag divider according to claim 17 wherein the upper portion of the upper fabric is folded over the top of the collar and stitched to an outer surface of the collar.

19. A golf bag divider according to claim 11 wherein the center divider assembly further comprises:

(a) a fabric center partition wall having a top portion; and (b) center fabric forming a closed sleeve stitched to the top portion of the center partition wall, said sleeve containing a brace.

* * * * *